US010866009B2

(12) United States Patent
Ishimatsu

(10) Patent No.: US 10,866,009 B2
(45) Date of Patent: Dec. 15, 2020

(54) AIR CONDITIONING SYSTEM REGULATING TEMPERATURE AND HUMIDITY OF AIR

(71) Applicant: SHINWA CONTROLS CO., LTD, Kawasaki (JP)

(72) Inventor: Takuya Ishimatsu, Kawasaki (JP)

(73) Assignee: Shinwa Controls Co., Ltd, Kawasaki (JP)

( * ) Notice: Subject to any disclaimer, the term of this patent is extended or adjusted under 35 U.S.C. 154(b) by 72 days.

(21) Appl. No.: 16/306,093

(22) PCT Filed: Apr. 10, 2018

(86) PCT No.: PCT/JP2018/015020
§ 371 (c)(1),
(2) Date: Nov. 30, 2018

(87) PCT Pub. No.: WO2018/207531
PCT Pub. Date: Nov. 15, 2018

(65) Prior Publication Data

US 2019/0234652 A1 Aug. 1, 2019

(30) Foreign Application Priority Data

Apr. 10, 2017 (JP) ..... 2017-093179

(51) Int. Cl.
*F24F 13/30* (2006.01)
*F24F 6/10* (2006.01)
(Continued)

(52) U.S. Cl.
CPC ..... *F24F 13/30* (2013.01); *F24F 3/14* (2013.01); *F24F 6/10* (2013.01); *F24F 11/0008* (2013.01); *F24F 3/161* (2013.01)

(58) Field of Classification Search
CPC ..... F24F 11/0008; F24F 13/30; F24F 3/14; F24F 3/161; F24F 6/10; F24F 13/28
See application file for complete search history.

(56) References Cited

U.S. PATENT DOCUMENTS 7,201,013 B2 * 4/2007 Yabu ..... B01D 53/261 62/271
8,006,509 B2 * 8/2011 Matsui ..... F24F 3/1411 62/271

(Continued)

FOREIGN PATENT DOCUMENTS

JP H09-229408 A1 9/1997
JP 2001-201098 A1 7/2001

(Continued)

OTHER PUBLICATIONS

Japanese Office Action (Application No. 2017-093179) dated Jun. 6, 2017 (with English translation).

(Continued)

*Primary Examiner* — Filip Zec
(74) *Attorney, Agent, or Firm* — Burr & Brown, PLLC

(57) ABSTRACT

A downsized air conditioning system including a cooling device that cools air introduced into the air conditioning system to condense moisture contained in the air; a heating device that heats the air; and a humidification device that humidifies the air; wherein: in a plan view of the air conditioning system, at least a part of the humidification device is overlapped with at least a part of the cooling device; the heating device includes first and second heating devices, and in a plan view, at least a part of the first heating device and at least a part of the second heating device are respectively overlapped with at least a part of the cooling device; and when seen along an introduction direction of the air into the air conditioning system, at least a part of the (Continued)

humidification device is overlapped with at least a part of the heating device.

3 Claims, 4 Drawing Sheets

(51) Int. Cl.

| | |
|---|---|
| ***F24F 3/14*** | (2006.01) |
| ***F24F 11/00*** | (2018.01) |
| *F24F 3/16* | (2006.01) |

(56) References Cited

U.S. PATENT DOCUMENTS

| | | | | |
|---|---|---|---|---|
| 8,886,024 | B2 * | 11/2014 | Tyburk | F24F 13/20 392/347 |
| 9,188,359 | B2 * | 11/2015 | Ishimoto | F24F 3/1411 |
| 9,631,834 | B2 * | 4/2017 | Uselton | F24F 1/14 |
| 9,857,093 | B2 * | 1/2018 | Son | F24F 13/20 |
| 2010/0218534 | A1 | 9/2010 | Yabu et al. | |
| 2011/0036541 | A1 * | 2/2011 | Takada | F24F 12/006 165/59 |
| 2018/0128510 | A1 * | 5/2018 | LePoudre | F24F 5/0003 |
| 2018/0238580 | A1 | 8/2018 | Ikeda et al. | |

FOREIGN PATENT DOCUMENTS

| | | | |
|---|---|---|---|
| JP | 2002-162053 | A1 | 6/2002 |
| JP | 2004-003716 | A1 | 1/2004 |
| JP | 2009-092298 | A1 | 4/2009 |
| JP | 5886463 | B1 | 3/2016 |

OTHER PUBLICATIONS

Japanese Office Action (Application No. 2017-093179) dated Jul. 14, 2017 (with English translation).
International Search Report and Written Opinion (Application No. PCT/JP2018/015020) dated Jul. 3, 2018.
Korean Office Action (Application No. 10-2018-7036472) dated Mar. 2, 2020 (with English translation).
English Translation of International Preliminary Report on Patentability (Chapter 1) (Application No. PCT/JP2018/015020) dated Nov. 21, 2019, 6 pages.

* cited by examiner

AIR CONDITIONING SYSTEM REGULATING TEMPERATURE AND HUMIDITY OF AIR

BACKGROUND OF THE INVENTION

Field of the Invention

The present invention relates to an air conditioning system.

Description of Related Art

In a manufacturing step of semiconductor devices, an air conditioning system has been conventionally used for precisely control a temperature and a humidity of atmospheric air. For example, JP5886463B1 discloses an air conditioning system comprising a cooling unit that cools and dehumidifies air introduced into the air conditioning system, a heating unit that heats the air having passed through the cooling unit up to a predetermined temperature, and a humidification device that humidifies the air having passed through the heating unit.

The air conditioning system is required to be further downsized in order to enable installation thereof in a narrow space, and to improve a degree of freedom of a location where it is installed.

In the conventional air conditioning system disclosed in JP5886463B1, the air, which has moved upward to pass through the cooling unit so as to be cooled and dehumidified, turns its flowing direction into a horizontal direction so as to move toward the heating unit. The air having passed through the heating unit so as to be heated moves still in the horizontal direction and is humidified by the humidification device. The air having passed through the humidification device further moves also in the horizontal direction, and is sent by a blower to an outside space such as a cleanroom. Because of this system structure, the conventional air conditioning system disclosed in JP5886463B1 could not be sufficiently downsized as a whole. In particular, in the conventional air conditioning system, there remains an issue in further downsizing a size of the system when seen from above, i.e., a footprint thereof.

SUMMARY OF THE INVENTION

The present invention has been made in consideration of these circumstances. The object of the present invention is to provide a downsized air conditioning system.

The air conditioning system of the present invention is an air conditioning system that regulates a temperature and a humidity of air introduced thereinto, comprising:

a cooling device that cools the air introduced into the air conditioning system so as to condense moisture contained in the air;

a heating device that heats the air; and a humidification device that humidifies the air;

wherein:

in a plan view of the air conditioning system, at least a part of the humidification device is overlapped with at least a part of the cooling device;

the heating device includes a first heating device and a second heating device, and in a plan view, at least a part of the first heating device and at least a part of the second heating device are respectively overlapped with at least a part of the cooling device; and when seen along an introduction direction of the air into the air conditioning system, at least a part of the humidification device is overlapped with at least a part of the heating device.

In the air conditioning system of the present invention, an introduction port of air into the air conditioning system may be opened toward one side of a first direction, and the humidification device may be disposed on the one side of the first direction with respect to the heating device.

In the air conditioning system of the present invention, the cooling device may include a plurality of heat transfer fins, the heat transfer fins may extend in a direction that is inclined with respect to a horizontal direction and to a vertical direction; and air flowing through the cooling device is guided by the heat transfer fins to move in the direction that is inclined with respect to the horizontal direction and to the the vertical direction so as to flow gradually upward from an upstream side toward a downstream side.

According to the present invention, a downsized air conditioning system can be provided.

DETAILED DESCRIPTION OF THE INVENTION

Figure 1:
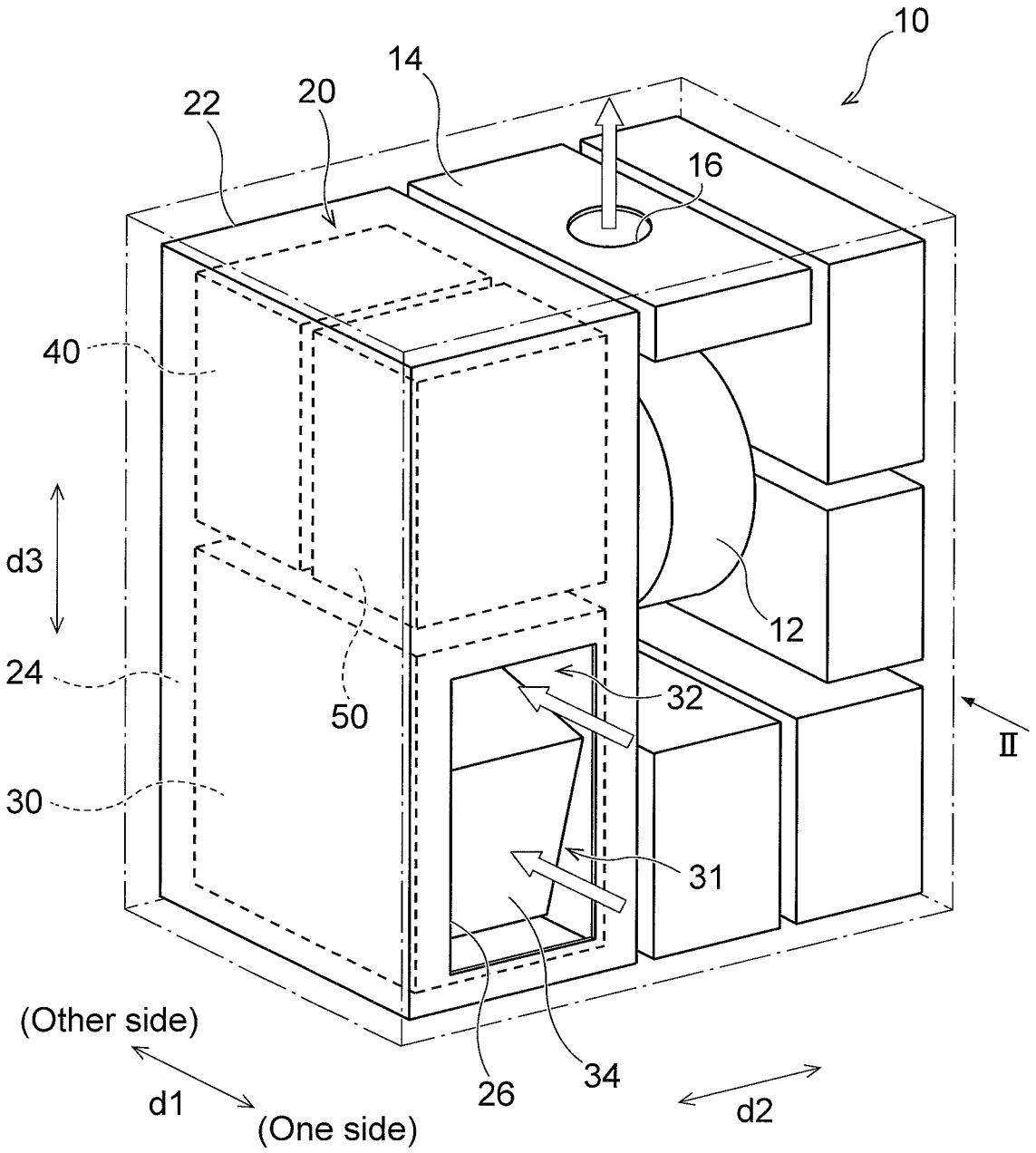
FIG. 1 is a view for describing one embodiment according to the present invention, which is a perspective view schematically showing an example of an air conditioning system.

Herebelow, one embodiment of the present invention is described. In the drawings attached to this specification, a scale size and an aspect ratio may be changed and exaggerated from the actual one, for the convenience of easiness in illustration and understanding.

In addition, terms specifying shapes, geometric conditions and their degrees, e.g., terms such as "parallel", "perpendicular", "same", etc. and values of a length and an angle, etc., are not limited to their strict definitions, but should be construed to include a range capable of exerting a similar function.

Figure 2:
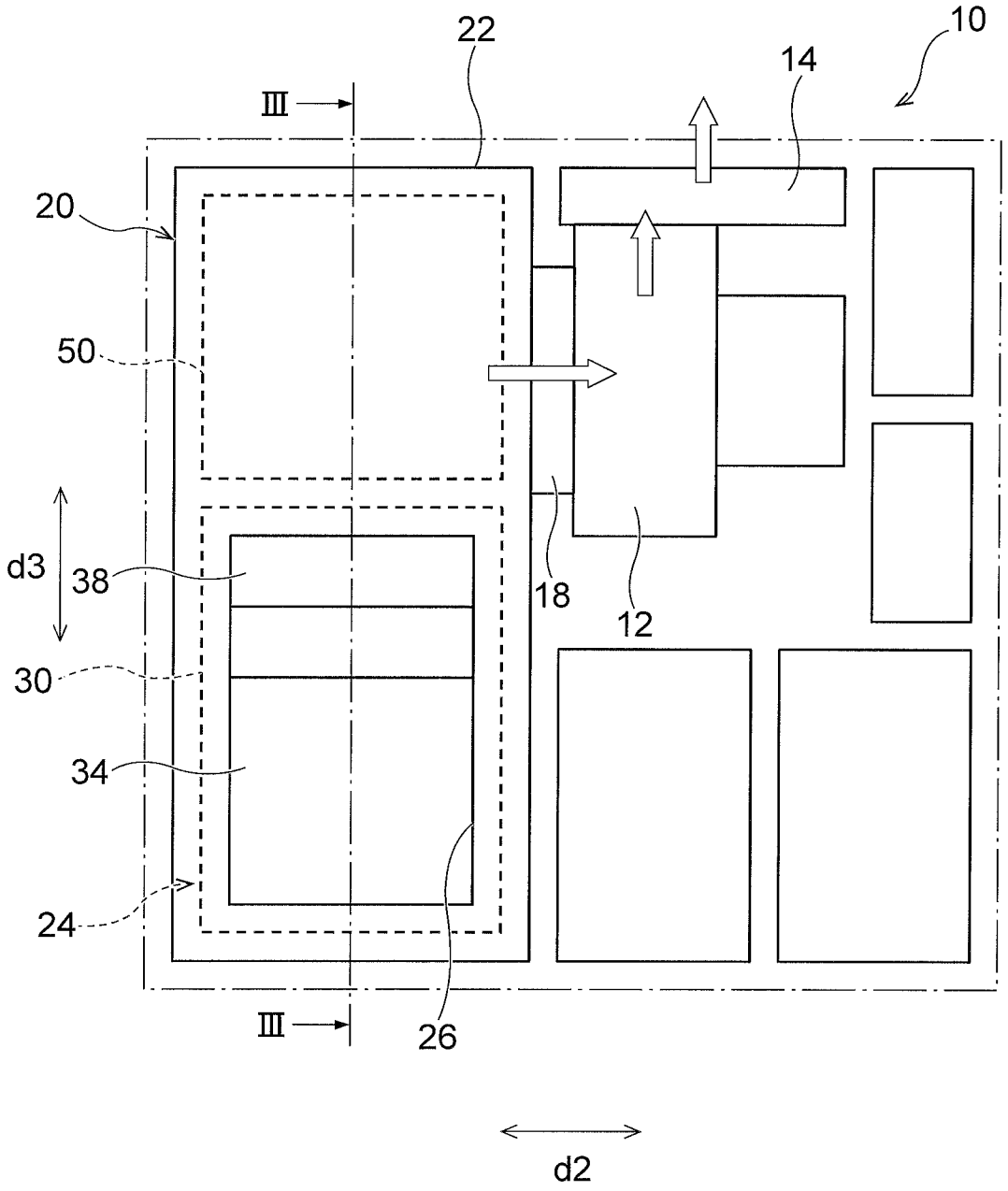
FIG. 2 is a view of the air conditioning system of FIG. 1 seen from a direction of an arrow II.
Figure 3:
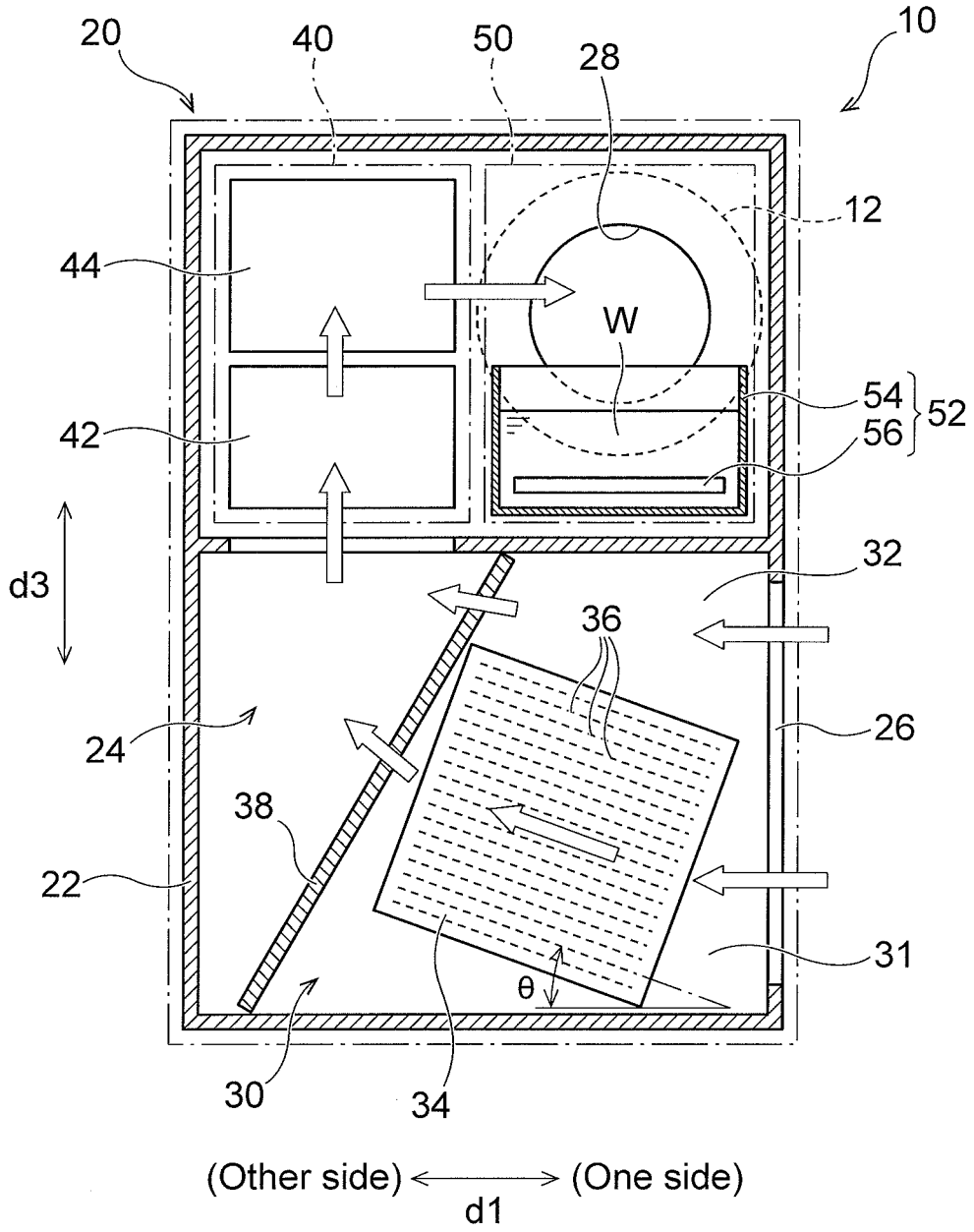
FIG. 3 is a sectional view corresponding to a III-III line of FIG. 2.
Figure 4:
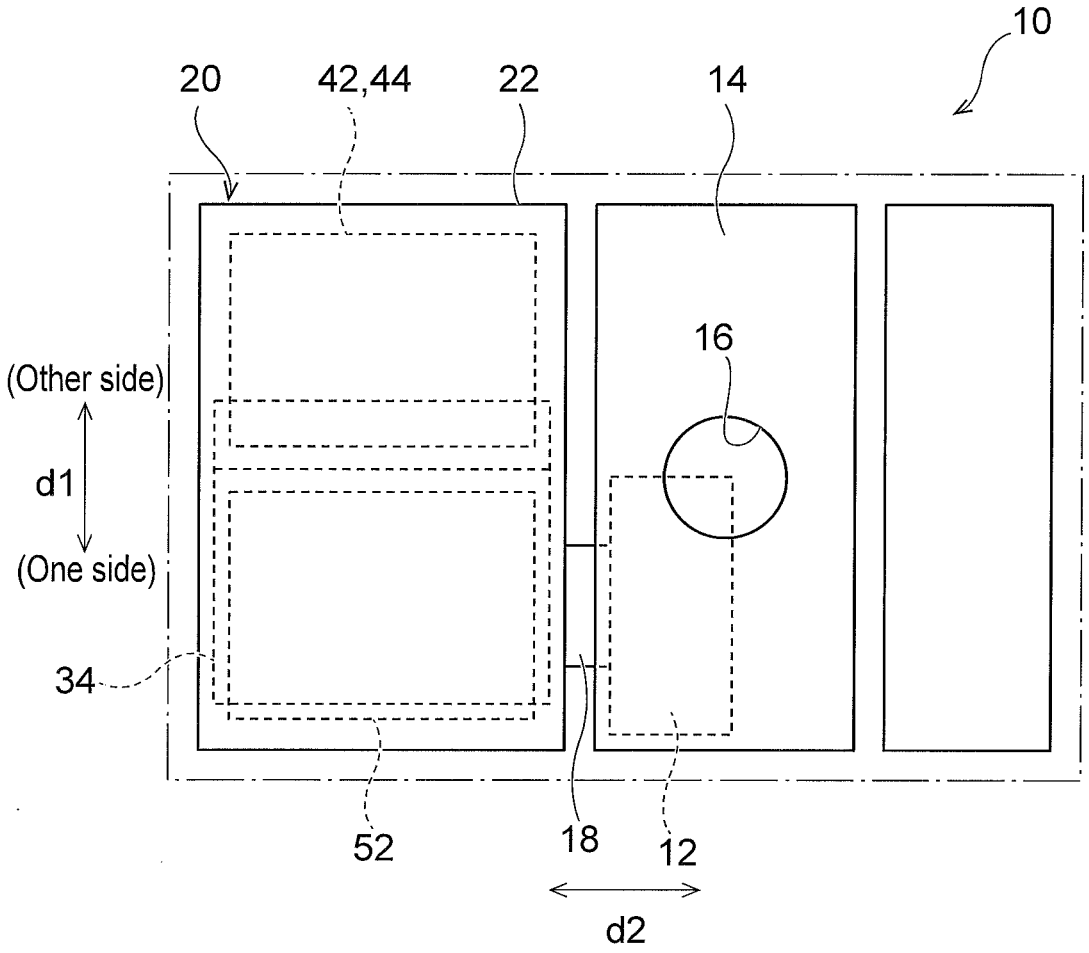
FIG. 4 is a view showing the air conditioning system seen from above.

FIGS. 1 to 4 are views for describing one embodiment according to the present invention. FIG. 1 is a perspective view schematically showing an example of an air conditioning system 10. FIG. 2 is a view of the air conditioning system 10 of FIG. 1 seen from a direction of an arrow II. FIG. 3 is a sectional view corresponding to a III-III line of FIG. 2. FIG. 4 is a view showing the air conditioning system 10 seen from above.

An air conditioning system 10 is a system that regulates a temperature and a humidity of air introduced thereinto. For example, the air conditioning system 10 may be used as a system that is installed in a plant for manufacturing semiconductor devices, and is configured to send air whose temperature and humidity are precisely regulated to a semiconductor device manufacturing apparatus installed in a cleanroom of the plant. In the example shown in FIGS. 1 and 2, the air conditioning system 10 includes a temperature and humidity controller 20, a blower 12 and a chamber 14.

In the temperature and humidity controller 20, a temperature and a humidity of air introduced from outside are regulated. The temperature and humidity controller 20 has a housing 22. In the housing 22, there are a cooling unit 30 that cools air introduced into the housing 22, a heating unit 40 that heats the air cooled by the cooling unit 30 so as to regulate a temperature thereof, and a humidification unit 50 that humidifies the air whose temperature has been regulated by the heating unit 40 so as to regulate a humidity thereof. The housing 22 has an upstream side opening 26 and a downstream side opening 28. The downstream side opening 28 is in communication with the blower 12 through a connection unit 18. The blower 12 generates a driving force for flowing air in the housing 22. The blower 12 has a not-shown fan. The fan is rotated by a drive source such as a motor, not shown. Air in an air flow path 24 is sucked by the blower 12 through the downstream side opening 28, so that outside air is introduced into the housing 22 through the upstream side opening 26. Namely, the upstream side opening 26 serves as an air introduction port for introducing outside air into the air conditioning system 10 (housing 22). As a result, an airflow, which moves from the upstream side opening 26 toward the downstream side opening 28, through the cooling unit 30, the heating unit 40 and the humidification unit 50 in this order, is generated in the housing 22. Namely, the air flow path 24 extending from the upstream side opening 26 toward the downstream side opening 28 is formed in the housing 22. In the illustrated example, the upstream side opening 26 is opened toward one side of a first direction d1 which is in parallel with a horizontal direction. Outside air is introduced into the air conditioning system 10 (housing 22) such that it moves from the one side to the other side generally along the first direction d1 through the upstream side opening 26. The upstream side opening 26 may be equipped with a filter device for removing dusts contained in the outside air. In this specification, the "upstream side" means an upstream side of a flow of air generated by the activation of the blower 12 in the air flow path 24, and the "downstream side" means a downstream side of a flow of air generated by the activation of the blower 12 in the air flow path 24. In FIGS. 1 to 3, the direction along which the air flows in the air conditioning system 10 is shown by white arrows.

In the example shown in FIGS. 1 and 2, the air in the housing 22, which has been sucked by the blower 12, is discharged through the chamber 14 toward an instrument such as a semiconductor device manufacturing apparatus. The chamber 14 stirs air flowing from the blower 12 into the chamber 14 so as to make uniform a temperature and a humidity of the air. For example, one or more baffle plate(s), not shown, is (are) provided in the chamber 14. A part of the air flowing from the blower 12 into the chamber 14 collides with the baffle plate(s) so that a turbulent flow is generated on the downstream side of the baffle plate(s). Thus, the air generating the turbulent flow and the air having passed through the chamber 14 without colliding with the baffle plate(s) are mixed. Namely, the baffle plate has a function of stirring the air flowing into the chamber 14. The air stirred in the chamber 14 is discharged from an exhaust port 16 of the chamber 14 toward an instrument such as a semiconductor device manufacturing apparatus, through an air duct, not shown.

Next, details of the temperature and humidity controller 20 are described with reference mainly to FIG. 3. The temperature and humidity controller 20 includes, in the housing 22, the cooling unit 30 configured to cool air introduced from the upstream side opening 26, the heating unit 40 configured to heat the air cooled by the cooing unit 30 so as to regulate a temperature thereof, and the humidification unit 50 configured to humidify the air whose temperature has been regulated by the heating unit 40 so as to regulate a humidity thereof.

The cooling unit 30 has a cooling device 34 and an air mixture member 38 disposed on the downstream side of the cooling device 34. The cooling device 34 is disposed in the housing 22 (air flow path 24), and cools the air introduced into the air flow path 24 so as to condense moisture contained in the air. For example, in a cooling circuit formed by connecting by pipes a compressor, a condenser, an expansion valve and an evaporator in this order so that a heating medium circulates therethrough, the cooling device 34 in this embodiment may be the evaporator. The cooling unit 30 may have a variable cooling capacity. A part of the air introduced into the housing 22 through the upstream side opening 26 comes into contact with the cooling device 34, in particular, the below-described heat transfer fins 36 so as to be cooled, and moves toward the heating unit 40 located on the downstream side of the cooling unit 30. When the air introduced into the housing 22 is cooled by the cooling device 34, the moisture contained in the air is condensed to become water droplets, which attach to the cooling device 34 (heat transfer fins 36). In this embodiment, the water droplets attaching to the cooling device 34 (heat transfer fins 36) fall into a not-shown drain pan provided below the cooling device 34.

In the example shown in FIG. 3, the cooling device 34 is located on a lower side of a space between the upstream side opening 26 and the air mixture member 38. A path is formed above the cooling device 34, through which the outside air introduced from the upstream side opening 26 moves toward the air mixture member 38 bypassing the cooling device 34. Thus, in the cooling unit 30, a first path 31, which extends from the upstream side opening 26 toward the air mixture member 38 through the cooling device 34, and a second path 32, which extends from the upstream side opening 26 toward the air mixture member 38 bypassing the cooling device 34, are formed. In other words, a part of the air flow path 24 in the cooling unit 30, particularly in the illustrated example, a part, which is on the downstream side of the upstream side opening 26 and on the upstream side of the air mixture member 38, is partitioned into the first path 31 and the second path 32. The cooling device 34 is disposed in the first path 31. In the illustrated example, the first path 31 is disposed below the second path 32.

Since the cooling unit 30 includes the first path 31 and the second path 32, air having passed through the first path 31 so as to be cooled and dehumidified by the cooling device 34, and air having passed through the second path 32 are mixed in the cooling unit 30, and the mixed air flows into the heating unit 40 and the humidification unit 50. Thus, a heating volume in the heating unit 40 and a humidification volume in the humidification unit 50 for causing air introduced into the air flow path 24 to have a desired temperature and humidity can be reduced. Namely, amounts of consumption energy in the heating unit 40 and the humidification unit 50 can be reduced. Thus, energy utilization efficiency of the air conditioning system 10 as a whole can be effectively improved.

The air mixture member 38 is a member that promotes the mixture of air having passed through the first path 31 and air having passed through the second path 32, in order to make uniform a temperature and a humidity of the air to flow into the heating unit 40 and the humidification unit 50. The air mixture member 38 is provided on the downstream side of the first path 31 and the second path 32. Particularly in the illustrated example, the air mixture member 38 can be formed by a plate-like member whose plate surface extends in a direction intersecting with a direction in which air flows in the first path 31 and with a direction in which air flows in the second path 32. In the example shown in FIG. 3, the plate-like member constituting the air mixture member 38 is inclined with respect to the horizontal direction (first direction d1) and to a vertical direction (third direction d3). In particular, the plate-like member is inclined with respect to the horizontal direction and to the vertical direction, such that an upper end of the plate-like member is located on the upstream side (one side in the first direction d1) in the cooing unit 30, as compared with a lower end of the plate-like member. For example, a plate-like member (punching panel) provided with a number of holes may be used as such an air mixture member 38. Since the cooling unit 30 has such an air mixture member 38, a temperature and a humidity of air flowing from the cooling unit 30 into the heating unit 40 can be made uniform, whereby a temperature and a humidity of the air can be more precisely regulated in the heating unit 40 and the humidification unit 50.

The cooing unit 30 may be equipped with a damper member for regulating an opening degree of the first path 31 and/or a damper member for regulating an opening degree of the second path 32. Alternatively, one damper member capable of simultaneously regulating an opening degree of the first path 31 and an opening degree of the second path 32 may be provided. Due to the provision of such a damper member(s), an amount of air passing through the first path 31 and/or an amount of air passing through the second path 32 can be regulated, so that a mixture ratio between the air passing through the first path 31 and the air passing through the second path 32 can be effectively regulated.

In the example shown in FIG. 3, the cooling device 34 includes a plurality of the heat transfer fins 36 that are in contact with the air flowing through the first path 31. The heat transfer fins 36 are provided such that heat of air flowing through the first path 31 and heat of a heating medium flowing through the cooling device 34 can be exchanged. Thus, the heat transfer fins 36 are configured to sufficiently ensure a contact area between the air flowing through the first path 31 and the cooling device 34 so as to promote the heat exchange between the air flowing through the first path 31 and the heating medium flowing through the cooling device 34.

The illustrated cooling device 34 has a rectangular profile when seen from a second direction d2 that is perpendicular to the first direction d1 and is in parallel with the horizontal direction. The heat transfer fins 36 extend in parallel with one another, and extend in parallel with a pair of opposed edges of two pairs of opposed edges which form the rectangular profile seen from the second direction d2. In the illustrated example, the cooling device 34 is disposed such that each of the edges forming the rectangular profile seen from the second direction d2 is inclined with respect to the horizontal direction (first direction d1) and to the vertical direction (third direction d3). Thus, each heat transfer fin 36 also extends in a direction that is inclined with respect to the horizontal direction and to the vertical direction. Particularly in the illustrated example, each heat transfer fin 36 extends such that its height gradually increases along a flow of air introduced into the housing 22 through the upstream side opening 26, i.e., from the upstream side toward the downstream side along the first direction d1.

Since each heat transfer fin 36 extends such that its height gradually increases from the upstream side toward the downstream side along an airflow, air flowing through the first path 31 (cooling device 34) is guided by the heat transfer fins 36 to move in a direction that is inclined with respect to the horizontal direction and to the vertical direction so as to move gradually upward from the upstream side toward the downstream side. Thus, the air having passed through the first path 31 (cooling device 34) is guided upward so as to move toward the heating unit 40 disposed above the cooling unit 30. As a result, the air having passed through the first path 31 so as to be cooled and dehumidified by the cooling device 34 is restrained from stagnating in a lower corner in the housing 22, and the mixture of the air having passed through the first path 31 and the air having passed through the second path 32 positioned above the first path 31 can be further promoted. In addition, the mixed air can be smoothly directed toward the heating unit 40. An angle θ defined between a direction in which the heat transfer fin 36 extends and the horizontal direction (first direction d1) may be not less than 5 degrees and not more than 40 degrees, for example. Preferably, the angle θ may be not less than 10 degrees and not more than 30 degrees.

The heating unit 40 has a function of heating the air having been cooled and dehumidified by the cooling unit 30 so as to regulate a temperature thereof. In the example shown in FIG. 3, the heating unit 40 is provided above the cooling unit 30. In the illustrated example, the heating unit 40 includes a first heating device 42 and a second heating device 44 in this order from the upstream side of a flow of air generated in the air flow path 24. Particularly in the illustrated example, the first heating device 42 is provided above the cooling unit 30, and the second heating device 44 is provided above the first heating device 42. The air having been cooled and dehumidified by the cooling unit 30 moves upward so as to be firstly heated by the first heating device 42. Then, the air having been heated by the first heating device 42 further moves upward so as to be heated by the second heating device 44. The air having been heated by the second heating unit 44 turns its flowing direction, and particularly moves toward the one side along the first direction d1 so as to flow into the humidification unit 50. When the air having passed through the cooling unit 30 is heated by the heating unit 40, an amount of saturated steam of the heated air increases. Thus, a humidity, which is a ratio of an amount of actually contained steam relative to the amount of saturated steam, decreases.

For example, the first heating device 42 may be a heating device that utilizes at least a part of heat of a heating medium that has an increased temperature in the aforementioned cooling circuit. To be specific, the first heating device 42 may be a heating device that imparts heat to the air flowing through the first heating device 42 from the heating medium having passed through the compressor in the aforementioned cooling circuit including the cooling device 34 so as to have an increased temperature. When such a heating device is used as a heating device constituting the heating unit 40, the heat, which is generated in the cooling circuit when the air is cooled and dehumidified by the cooling unit 30, can be utilized to heat the air. Thus, an amount of energy to be consumed in the heating unit 40 can be reduced. The second heating device 44 may be an electric heater, for example. The first heating device 42 and/or the second heating device 44 may have a variable heating capacity. For example, the second heating device 42 may have a variable heating capacity. As one example, when the aforementioned heating device that uses at least a part of heat of the heating medium having an increased temperature in the cooling circuit is used as the first heating device 42, and an electric heater having a variable heating capacity is used as the second heating device 44, a temperature of the air flowing through the heating unit 40 can be precisely regulated, while an amount of energy to be consumed in the heating unit 40 can be reduced. Herein, although the example in which the heating unit 40 has the two heating devices, i.e., the first heating device 42 and the second heating device 44 is described, the present invention is not limited thereto. The heating unit 40 may include one heating device or three or more heating devices.

FIG. 4 is a view showing the air conditioning system 10 seen from above. In the example shown in FIGS. 1 and 4, in a plan view of the air conditioning system 10, at least a part of the heating device 42, 44 is overlapped with at least a part of the cooling device 34. In other words, at least a part of the heating device 42, 44 is positioned above, in more detail, vertically above at least a part of the cooling device 34. Further in other words, at least a part of the heating device 42, 44 is positioned above at least a part of the cooling device 34 when seen from the first direction d1, and is positioned above at least a part of the cooling device 34 when seen from the second direction d2 as shown in FIG. 3. Preferably, in a plan view of the air conditioning system 10, at least a part of the first heating device 42 and at least a part of the second heating device 44 are respectively overlapped with at least a part of the cooling device 34. Thus, a size of the air flow path 24 in the horizontal direction can be made smaller. Accordingly, a size of the air conditioning system 10 in a plan view, i.e., a footprint thereof can be made smaller.

The humidification unit 50 is provided in order to humidify the air that has been heated by the heating unit 40 so that its humidity has been lowered. For this purpose, the humidification unit 50 is disposed on the downstream side of the heating unit 40. In the example shown in FIG. 3, the humidification unit 50 is positioned between the heating unit 40 and the downstream side opening 28 along a flow of air generated in the air flow path 24. In the example shown in FIG. 3, the humidification unit 50 includes a humidification device 52. The humidification device 52 has a storage tank 54 that stores water W, which is opened upward into the air flow path 24, and a heater 56 accommodated in the storage tank 54 so as to heat the water W in the storage tank 54.

In the illustrated example, the humidification unit 50 is disposed on the one side of the first direction d1 with respect to the heating unit 40. In particular, the humidification device 52 is disposed on the one side of the first direction d1 with respect to the heating device 42, 44. The air flow path 24 is configured such that air, which has been introduced into the air conditioning system 10 (housing 22) through the upstream side opening 26 opened toward the one side of the first direction d1 so as to move from the one side toward the other side generally along the first direction d1, turns its flowing direction respectively by the cooling unit 30 and by the heating unit 40, so that the air moves from the heating unit 40 to the humidification unit 50 from the other side toward the one side of the first direction d1. Thus, a size of the temperature and humidity controller 20 (housing 22, air flow path 24) along the first direction d1 can be reduced, whereby a size in a plan view of the air conditioning system 10, i.e., a footprint thereof can be made smaller.

The storage tank 54 is a container that accommodates water W used for humidifying air. The storage tank 54 has a box-like shape having an opened upper surface, and is made of a plate material such as stainless. A supply pipe for supplying water W into the storage tank 54 and/or a discharge pipe for discharging water W therefrom may be connected to the storage tank 54. In addition, in order to detect a level of a water surface in the storage tank 54, a wafer surface detector such as a float switch may be provided inside the storage tank 54. In this case, based on a signal of the water surface detected by the water surface detector, the supply of water W into the storage tank 54 and/or the discharge of water W from the storage tank 54 can be controlled.

The heater 56 is, e.g., an electric heater, and is used for heating the water W in the storage tank 54 so as to generate steam. A heating volume of the heater 56 is regulatable, so that an amount of steam generated by water W stored in the storage tank 54 can be regulated. Thus, a humidity of the air flowing through the humidification unit 50 can be regulated to a desired humidity.

The humidification unit 50 is in communication with the blower 12 through the downstream side opening 28 of the housing 22 and the connection unit 18. The air having flown from the heating unit 40 into the humidification unit 50 flows above the storage tank 54. At this time, the air is mixed with the steam generated from the water W in the storage tank 54, so that its humidity is regulated. The air whose humidity having been regulated passes sequentially through the downstream side opening 28 and the connection unit 18 so as to flow into the blower 12.

In the example shown in FIGS. 1 and 4, when the air conditioning system 10 is seen from above, i.e., in a plan view of the air conditioning system 10, at least a part of the humidification device 52 is overlapped with at least a part of the cooling device 34. In other words, at least a part of the humidification device 52 is positioned above, in more detail, vertically above at least a part of the cooling device 34. Further in other words, at least a part of the humidification device 52 is positioned, as shown in FIG. 2, above at least a part of the cooling device 34 when seen from the introduction direction (first direction d1) of the air into the upstream side opening 26 of the housing 22 of the temperature and humidity controller 20, and is positioned, as shown in FIG. 3, above at least a part of the cooling device 34 when seen from the direction (second direction d2) that is perpendicular to the first direction d1 and is in parallel with the horizontal direction.

As shown by the aforementioned JP5886463B1, for example, in the conventional air conditioning system, the air flow path has a substantially L-shape as a whole in a side view. In FIG. 1 of JP5886463B1, the air flow path has a shape like "L" which is rotated clockwise at 90 degrees. The cooling device, the heating device and the humidification device are sequentially disposed in the air passage path. In addition, the humidification device is located at a position deviated from above the cooling device. Thus, the conventional air conditioning system has a problem in that a horizontal size of the air flow path is large. However, there has been no air conditioning system capable of sufficiently solving such a problem. In particular, in an air conditioning system having an air flow path having a substantially L-shape as a whole, as shown in JP5886463B1, it has been considered to be impossible that a horizontal size thereof is made smaller than a specific size.

On the other hand, the present inventors have conducted extensive studies on the positioning of the cooling device 34 and the humidification device 52 in order to solve the aforementioned problems, and found that a horizontal size of the air flow path 24 could be sufficiently made smaller. Namely, in the air conditioning system 10 in this embodiment, at least a part of the humidification device 52 is overlapped with at least a part of the cooling device 34, in a plan view of the air conditioning system 10. Thus, as compared with a conventional air conditioning system, a horizontal size of the air flow path 24 can be sufficiently made smaller, whereby a size of the air conditioning system 10 in a plan view, i.e., a footprint thereof can be sufficiently made smaller. Thus, the air conditioning system 10 can be effectively downsized.

Further, in the example shown in FIGS. 1 and 4, when seen along the introduction direction (first direction d1) of air into the air conditioning system 10, at least a part of the humidification device 52 is overlapped with at least a part of the heating device 42, 44. At this time, when seen along the introduction direction (first direction d1) of air into the air conditioning system 10, at least a part of the first heating device 42 and at least a part of the second heating device 44 may be respectively overlapped with at least a part of the humidification device 52. Thus, a size of the temperature and humidity controller 20 (housing 22, air flow path 24) along the second direction d2 can be made smaller, whereby a size of the air conditioning system 10 in a plan view, i.e., a footprint thereof can be further made smaller.

Next, an operation of the air conditioning system 10 is described.

When the not-shown fan of the blower 12 is rotated, air in the housing 22 (air flow path 24) is sucked through the connection unit 18 and the downstream side opening 28 of the housing 22, and the sucked air is sent to the chamber 14. Since the air in the housing 22 is sucked by the blower 12, outside air is introduced into the housing 22 through the upstream side opening (introduction port) 26. In particular, the outside air is introduced into the air conditioning system 10 (housing 22) such that the outside air is moved from the one side to the other side generally along the first direction d1, through the upstream side opening 26 that is opened toward the one side of the first direction d1. When the upstream side opening 26 is equipped with a filter device, dusts that can be contained in the outside air are removed by the filter device.

The air having been introduced into the housing 22 through the upstream side opening (introduction port) 26 flows into the cooling unit 30. A part of the air having flown into the cooling unit 30 passes through the first path 31, while another part of the air having flown thereinto passes through the second path 32. The air flowing through the first path 31 is cooled and dehumidified by the cooling device 34. More specifically, the air flowing through the first path 31 moves along the heat transfer fins 36 in the cooling device 34. The air is heat-exchanged with a heating medium flowing through the cooling circuit through the heat transfer fins 36, so that the air is cooled. At this time, moisture contained in the air is condensed to become water droplets which attach to the cooling device 34 (heat transfer fins 36). These water droplets fall into the drain pan provided below the cooling device 34. In this embodiment, as shown in FIG. 3, the cooling device 34 is inclined with respect to the horizontal direction (first direction d1) and to the vertical direction (third direction d3). Thus, each heat transfer fin 36 extends such that its height gradually increases from the upstream side toward the downstream side along a flow of air introduced into the housing 22 through the upstream side opening 26, i.e., along the first direction d1. Thus, the air flowing through the first path 31 is guided by the heat transfer fins 36 such that the air moves gradually upward from the upstream side toward the downstream side. As a result, the air having passed through the first path 31 so as to be cooled and dehumidified by the cooling device 34 can be effectively restrained from stagnating in a lower corner in the housing 22. In the second path 32, the air passes therethrough without being cooled.

The air having passed through the first path 31 and the air having passed through the second path 32 pass through the air mixture member 38 provided on the downstream side of the first path 31 and the second path 32. For example, the air mixture member 38 is a plate-like member (punching panel) provided with a number of holes. Mixture of the air having passed through the first path 31 and the air having passed through the second path 32 is promoted by the air mixture member 38. Thus, a temperature and a humidity of the air flowing from the cooling unit 30 into the heating unit 40 can be made uniform.

The air flowing into the heating unit 40 sequentially passes through the first heating device 42 and the second heating device 44 so as to be heated. The first heating device 42 is, e.g., a heating device that uses at least a part of heat of the heating medium whose temperature is increased in the cooling circuit. In this case, since the air can be heated by using the heat that is generated in the cooling circuit when the air is cooled and dehumidified by the cooling unit 30, an amount of energy to be consumed in the heating unit 40 can be reduced. The second heating device 44 is, e.g., an electric heater having a variable heating capacity. In this case, a temperature of the air flowing through the heating unit 40 can be precisely regulated.

The air having been heated by the heating unit 40 so that its temperature has been regulated moves from the heating unit 40 to the humidification unit 50, such that it moves from the other side to the one side of the first direction d1. In the humidification unit 50, the water W stored in the storage tank 54 is heated by the heater 56. Thus, steam is generated from the water W. The air having flown from the heating unit 40 into the humidification unit 50 flows above the storage tank 54. At this time, the air is mixed with the steam generated from the water W in the storage tank 54 so as to be humidified. Since a heating volume of the heater 56 is regulatable, an amount of the steam generated by the water W stored in the storage tank 54 can be regulated. Thus, a humidity of the air flowing through the humidification unit 50 can be regulated to a desired humidity.

The air with its humidity having been regulated by the humidification unit 50 is sucked by the blower 12, so that the air flows from the downstream side opening 28, which is opened to face the humidification unit 50, into the blower 12 through the connection unit 18. The air having been sucked by the blower 12 from the humidification unit 50 so as to be sent to the chamber 14 is stirred by the baffle plate(s) provided in the chamber 14. Thus, a temperature and a humidity of the air is made uniform. The air having been stirred in the chamber 14 is discharged from the exhaust port 16 of the chamber 14 toward an instrument such as a semiconductor device manufacturing apparatus, through the not-shown air duct.

The air conditioning system 10 in this embodiment is the air conditioning system 10 that regulates a temperature and a humidity of air introduced thereinto. The air conditioning system 10 comprises the cooling device 34 that cools the air introduced into the air conditioning system 10 so as to condense moisture contained in the air, the heating device 42, 44 that heats the air, and the humidification device 52 that humidifies the air. In a plan view of the air conditioning system 10, at least a part of the humidification device 52 is overlapped with at least a part of the cooling device 34. The heating device 42, 44 includes the first heating device 42 and the second heating device 44. In a plan view, at least a part of the first heating device 42 and at least a part of the second heating device 44 are respectively overlapped with at least a part of the cooling device 34. When seen along an introduction direction of the air into the air conditioning system 10, at least a part of the humidification device 52 is overlapped with at least a part of the heating device 42, 44.

According to such an air conditioning system 10, a horizontal size of the air flow path 24 can be sufficiently made smaller as compared with a conventional air conditioning system. Thus, a size of the air conditioning system 10 in a plan view, i.e., a footprint thereof can be sufficiently made smaller. As a result, the air conditioning system 10 can be effectively downsized.

In addition, according to such an air conditioning system 10, a size of the temperature and humidity controller 20 (housing 22, air flow path 24) along the second direction d2 that is perpendicular to the first direction d1 and is in parallel with the horizontal direction can be made smaller. Thus, a size of the air conditioning system 10 in a plan view, i.e., a footprint thereof can be further made smaller.

In the air conditioning system 10 in this embodiment, the introduction port 26 of air into the air conditioning system 10 is opened toward the one side of the first direction d1, and the humidification device 52 is disposed on the one side of the first direction d1 with respect to the heating device 42, 44.

According to such an air conditioning system 10, a size of the temperature and humidity controller 20 (housing 22, air flow path 24) along the first direction d1 can be made smaller. Thus, a size of the air conditioning system 10 in a plan view, i.e., a footprint thereof can be further made smaller.

In the air conditioning system 10 in this embodiment, the cooling device 34 includes a plurality of the heat transfer fins 36. The heat transfer fins 36 extend in a direction that is inclined with respect to the horizontal direction and to the vertical direction. Air flowing through the cooling device 34 is guided by the heat transfer fins 36 to move in the direction that is inclined with respect to the horizontal direction and to the vertical direction so as to flow gradually upward from the upstream side toward the downstream side.

According to such an air conditioning system 10, air flowing through the first path 31 (cooling device 34) is guided upward to move toward the heating unit 40 disposed above the cooling unit 30. Thus, the air having passed through the first path 31 so as to be cooled and dehumidified by the cooling device 34 is restrained from stagnating in a lower corner in the housing 22, and the mixture of the air having passed through the first path 31 and the air having passed through the second path 32 positioned above the first path 31 can be promoted. In addition, the mixed air can be smoothly directed toward the heating unit 40.

The invention claimed is:

1. An air conditioning system that regulates a temperature and a humidity of air introduced thereinto, comprising:

a cooling unit including a cooling device, the cooling device including at least a compressor, and cooling the air introduced into the air conditioning system so as to condense moisture contained in the air, and an air mixture member disposed on a downstream side of the cooling device;

a heating unit that heats the air, having a first heating device, the first heating device including a heating device that uses at least a portion of heat from a heating medium, a temperature thereof having been increased in the cooling unit, and a second heating device, including an electric heater having a variable heating capacity; and a humidification unit, including a humidification device having a heater provided in a storage tank and heating water stored in the storage tank, thereby generating steam that humidifies the air;

wherein:

in a plan view of the air conditioning system, at least a part of the humidification device is overlapped with at least a part of the cooling device;

in a plan view, at least a part of the first heating device and at least a part of the second heating device are respectively overlapped with at least another part of the cooling device; and when seen along an introduction direction of the air into the air conditioning system, at least another part of the first heating device and at least another part of the second heating device are overlapped with at least another part of the humidification device.

2. The air conditioning system according to claim 1, wherein:

an introduction port of air into the air conditioning system is opened toward one side of a first direction; and the humidification device is disposed on the one side of the first direction with respect to the heating device.

3. The air conditioning system according to claim 1, wherein:

the cooling device includes a plurality of heat transfer fins;

the plurality of heat transfer fins extend in a direction that is inclined with respect to a horizontal direction and to a vertical direction; and air flowing through the cooling device is guided by the plurality of heat transfer fins to move in the direction that is inclined with respect to the horizontal direction and to the vertical direction so as to flow upward from an upstream side toward a downstream side.

* * * * *